United States Patent [19]

Nagasawa et al.

[11] Patent Number: 4,758,105

[45] Date of Patent: Jul. 19, 1988

[54] RIBBON CASSETTE WITH GUIDE MECHANISM

[75] Inventors: Hideo Nagasawa, Kanagawa; Kazunori Matsumoto, Fujisawa, both of Japan

[73] Assignee: NCR Corporation, Dayton, Ohio

[21] Appl. No.: 934,979

[22] Filed: Nov. 24, 1986

[30] Foreign Application Priority Data

Dec. 27, 1985 [JP] Japan ..... 60-293421

[51] Int. Cl.[4] ..... B41J 32/02; B41J 35/04

[52] U.S. Cl. ..... 400/195; 400/196.1; 400/208; 400/248

[58] Field of Search ..... 400/194–196.1, 400/248, 208

[56] References Cited

U.S. PATENT DOCUMENTS

| | | | |
|---|---|---|---|
| 4,130,367 | 12/1978 | Guerrini et al. | 400/195 |
| 4,227,820 | 10/1980 | Falcetti | 400/195 |
| 4,279,522 | 7/1981 | Yonkers | 400/196.1 |
| 4,293,234 | 10/1981 | Yonkers et al. | 400/196.1 |
| 4,304,496 | 12/1981 | Vidwans | 400/195 |
| 4,383,774 | 5/1983 | Yonkers | 400/195 |
| 4,493,572 | 1/1985 | Van Ocker et al. | 400/196.1 |

*Primary Examiner*—Paul T. Sewell

*Attorney, Agent, or Firm*—Wilbert Hawk, Jr.; Albert L. Sessler, Jr.; George J. Muckenthale

[57] ABSTRACT

A ribbon stabilizer or guide member is provided in a ribbon reversing section of a ribbon cassette to prevent adverse twisting of the ribbon and to correct irregular twisting thereof and to maintain the normal reverse action or operation of the ribbon in its travel through the cassette.

3 Claims, 5 Drawing Sheets

RIBBON CASSETTE WITH GUIDE MECHANISM

BACKGROUND OF THE INVENTION

In the field of ink ribbons for printers, a ribbon supply spool and a ribbon take-up spool generally have been provided on opposite sides of a typing or printing station, together with means for reversing the direction of travel of the ribbon for repeated use thereof in an arrangement for the purpose of obtaining longer ribbon life. Also, the ink ribbon has been made to travel along a line of printing wherein the spools are positioned beyond the ends of the printing line and the ribbon is caused to travel at an angle relative to the print line to utilize a greater portion of the ribbon width. However, in the case of certain high-speed printers, a ribbon substantially as wide as the line of printing may be used and caused to travel in a direction normal to the print line and along with the record media. Additionally, it has been common to provide ink carrying or containing means operably associated with the ribbon for maintaining or replenishing a supply of ink therein for proper and extended-life printing operation.

In present-day printers, it is also common practice to provide and use a ribbon cassette carrying an endless ribbon which is caused to be driven past the printing station, and wherein the printing ribbon is either a pre-inked and disposable ribbon or a ribbon which is to be continuously or frequently reinked during the printing operation. The ribbon cassette itself may be of the stuffing-box type wherein the ribbon is contained within the cassette in random manner and such ribbon is unfolded at the cassette exit and caused to be driven past the printing station and then guided back into the cassette to be folded again in random manner therein.

Additionally, a ribbon may be utilized in a Mobius loop configuration within the cassette, it may be in substantially continuous contact with an inking core or like member, or the ribbon may have a plurality of coils thereof around a central core for controlled inking or reinking of the ribbon.

Furthermore, it is noted that the Mobius loop configuration enables uniform use of both sides of the ribbon and also the upper and lower portions of each side thereof to prolong ribbon life.

Representative documentation relating to ribbon cassettes or cartridges includes U.S. Pat. No. 4,130,367, issued to G. Guerrini et al. on Dec. 19, 1978, which discloses a cartridge having a Mobius loop section with guide elements of three ribs projecting alternately from a base and from a cover.

U.S. Pat. No. 4,227,820, issued to C. G. Falcetti on Oct. 14, 1980, discloses a cartridge wherein the ribbon is inverted to provide a Mobius loop by the use of two deflecting elements formed as a part of an arm and of the cover.

U.S. Pat. No. 4,279,522, issued to E. H. Yonkers on July 18, 1981, discloses a cartridge having a Mobius loop channel with the ribs extending upwardly from the base and a rib extending downwardly from the cover. The ribs are slanted and cause the ribbon to rotate about its axis during travel through the channel.

U.S. Pat. No. 4,293,234, issued to E. H. Yonkers et al. on Oct. 6, 1981, discloses a cartridge having a Mobius loop support molded integral with the cover and which includes a partition having downwardly converging end edges which serve to turn the ribbon.

U.S. Pat. No. 4,304,496, issued to M. P. Vidwans on Dec. 8, 1981, discloses a ribbon guide means having a front guide for vertical orientation of the ribbon, and upper and lower horizontal flanges for horizontal orientation of the ribbon to provide a 90° twist, and then a further 90° twist is effected between the flanges and a roller.

U.S. Pat. No. 4,383,774, issued to E. H. Yonkers on May 17, 1983, discloses a cartridge having a ribbon inverting device comprising a notch molded with the cover, a first ridge, a second ridge, a third ridge, and a fourth ridge to invert the ribbon 180°.

And, U.S. Pat. No. 4,493,572, issued to W. G. Van Ocker et al. on Jan. 15, 1985, discloses a long life inked-ribbon cassette with walls on the cover and a wall on a base to rotate the ribbon 180°.

SUMMARY OF THE INVENTION

The present invention relates generally to ribbon cassettes for use in impact printers. More particularly, the present invention relates to means for controlling and positioning the ribbon in the cassette for the purpose of extending the life of the ribbon and to maintain the ribbon in a proper attitude at all times.

The ribbon cassette or cartridge of the present invention may be used in business machines which incorporate an impact printer therein and which printer may be required to operate at high efficiency for extended periods of time. The cassette includes a ribbon drive means adjacent a stuffing-box type chamber along with various means for directing the ribbon in a path from the chamber, through a ribbon reversing section, past a front portion which is proximal the printing station of the machine, and then back to the drive means.

At times the lower edge of the ribbon is caught in the printer carriage and the ribbon irregularly or unintendedly turns over during travel along the print head and the platen. The ribbon goes into the storage area and then comes out to the print head while the ribbon is still in the irregularly folded condition.

The ribbon cassette has a ribbon reversing section adapted to correct an irregularly folded ribbon and includes ribbon guide means or ribbon stabilizing means having a recess of a depth which corresponds to approximately one-half the width of the ribbon. The guide means essentially comprises an irregular-shaped plate-like member with guide ends adjacent the recess which ends are in contact with the ends or edges of the ribbon at a position in the ribbon reversing section where the ribbon lies substantially horizontal in its twisted condition. The ribbon guide member or stabilizer is provided at the ribbon reversing area or section to return the folded ribbon to its normal condition.

In view of the above discussion, a principal object of the present invention is to provide guide mechanism in a ribbon cassette for extending the useful life of the ribbon.

Another object of the present invention is to provide a ribbon cassette having guide mechanism for correcting irregular twisting of the ribbon.

An additional object of the present invention is to provide a ribbon cassette with a ribbon reversing section and guide means therein for correcting irregular twisting of the ribbon.

A further object of the present invention is to provide guide mechanism in a ribbon cassette wherein the mechanism includes a guide member having an uneven surface thereon for ensuring controlled travel of the ribbon.

Additional objects and advantages of the present invention will become apparent and fully understood from a reading of the following specification taken together with the annexed drawing.

DESCRIPTION OF THE PREFERRED EMBODIMENT

Figure 1:
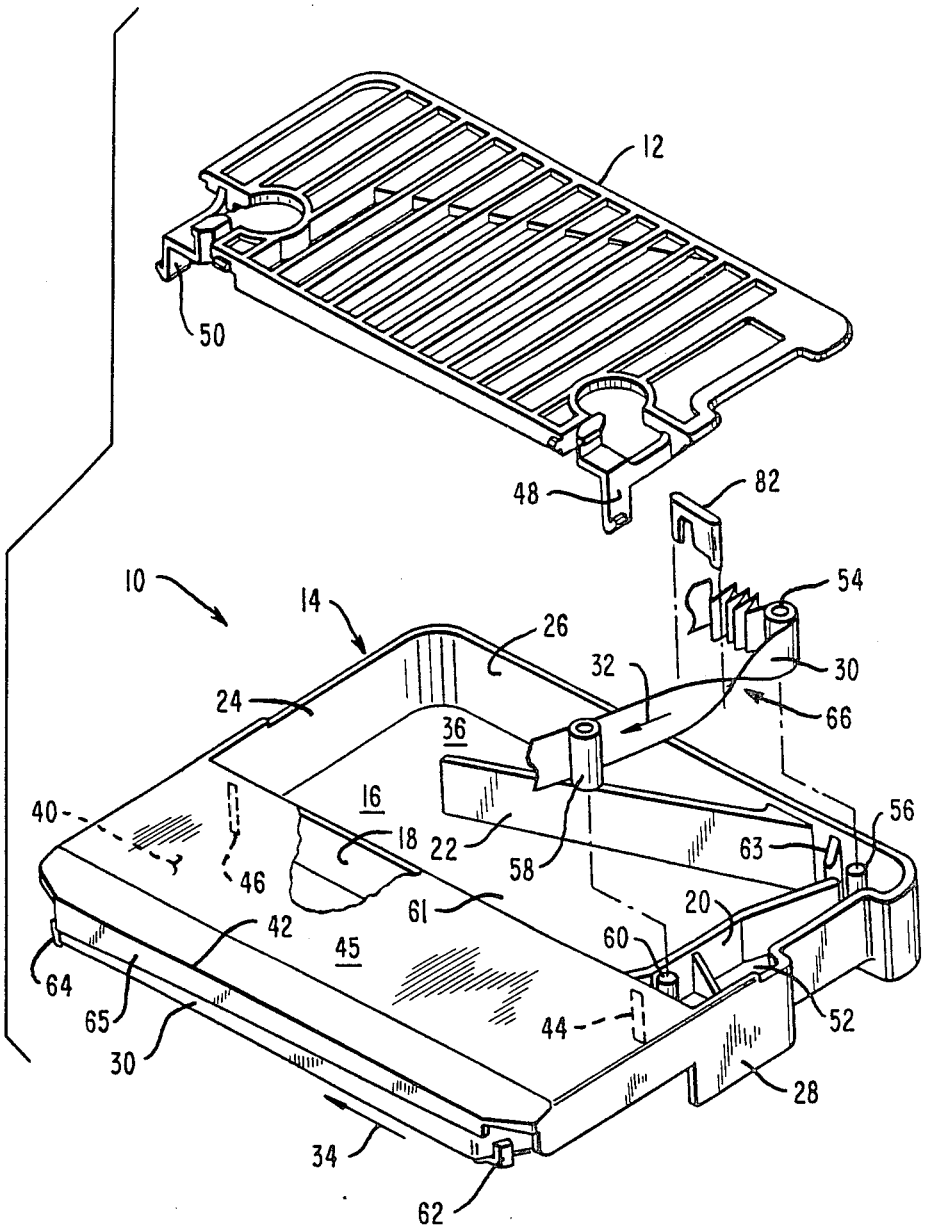
FIG. 1 is a perspective view showing certain parts of a ribbon cassette in exploded manner.

In FIG. 1 is illustrated a ribbon cassette, generally designated as 10, having the cover 12 removed upwardly therefrom to show the interior structure and the various components thereof in a preferred arrangement of the subject matter of the present invention. The cassette 10 includes a body 14, preferably of molded plastic material and in the shape of a generally rectangular flat case, for supporting the ribbon thereof and which cassette 10 is adapted to fit adjacent or along the printing station of a printer (not shown). The cassette body 14 includes a large cavity or chamber 16 formed in part by a front wall 18 extending nearly the width of the cassette 10, a rightward wall 20 of irregular shape and extending generally perpendicular rearward from the wall 18, and a rearward wall 22 angling toward a middle portion of the left side of the cassette body 14, as viewed in FIG. 1. The ribbon cassette 10 also includes exterior walls 24, 26 and 28 in addition to the wall 18 for forming an enclosure for the ribbon 30. While the orientation of the cassette 10 itself is not critical to operation of the parts therein, the terms used herein may apply to the orientation of the cassette 10 when installed on a printer and wherein the wall 26, as illustrated in FIG. 1, is nearest the operator when the cassette 10 is placed in a horizontal position. In certain printers the cassette 10 may be used in a vertical position wherein the wall 26 thereof is in an upwardly direction.

The ribbon 30 of the endless type is provided in the cavity 16 and is caused to be trained and driven therefrom in a path as shown by the arrow 32 at the right side of the cavity 16, and driven in the direction as shown by the arrow 34 at the front of the cassette 10. The body 14 of the cassette 10 is completed beyond the defined walls 18, 20, 22 of the cavity 16 by the irregular-formed right side wall 28 and continuing along the rear wall 26 and then along the left side wall 24. A second cavity 36 is formed in the rearward portion of the cassette body 14 by the angled wall 22, the rear wall 26 and a portion of the left side wall 24 for a purpose other than that of the present invention.

The front part of the cassette 10 is formed of a hollow portion 40 extending across the width of the cassette body 14 and occupying the space from the wall 18 to the front edge 42. The hollow, generally rectangular portion 40 is formed to provide a housing or protective cover for a print head or a plurality of individual print heads of the solenoid type (not shown) which are a part of the printer. When the cassette 10 is placed or mounted on the printer and the printer is operated, the print head or print heads are caused to be driven in a side-to-side direction under the protective cover of the cassette 10. A pair of openings 44, 46 are provided in the wall 18 and formed in the underside of the cover 45 over the hollow portion 40 at the sides of the wall 18 for providing an outlet port 44 and an inlet port 46 for the ribbon 30. The cover 12, shown upwardly in FIG. 1, encloses the cavity 16 and the cavity 36 of the body 14 of the cassette 10 formed by the walls 18, 20, 24 and 26. A pair of projections 48, 50 at the front of the cover 12 and integral therewith fit into openings (not shown) in the cassette body 14 for securing the cover 12 thereon.

At the right side of the large cavity 16 and being a portion of the body 14 of the cassette 10 is a third cavity 52 formed by the wall 20, a small portion of the wall 18 adjacent the opening 44, the wall 28 and a small portion of the wall 26 to provide a compartment for twisting the ribbon 30 in Mobius-loop manner as illustrated by the ribbon 30 in its path between a roller 54 journaled on a pin or shaft 56 at the rearward side of the cavity 52 and a roller 58 journaled on a pin or shaft 60 at the cavity 52 forward side. The wall 20 is connected with the wall 18 and approaches the roller 54 but is short of the rearward wall 26 to provide a passageway between the roller 54 and the wall 26 for the ribbon 30 to travel from the cavity 16 to the cavity 52.

The ribbon 30 is caused to be moved or driven in the direction of the arrows 32 and 34 by drive means, such as fully shown and described in U.S. Pat. No. 4,616,942. It is, of course, to be noted that while the ribbon 30 is shown as a single folded strand adjacent the roller 54 in the exploded view of FIG. 1, the ribbon 30 is folded many times in random manner to substantially fill or stuff the cavity 16, and further that the cavity 16 includes a floor 61 to support and contain the ribbon 30.

The ribbon 30 crosses a slightly raised dam portion (not shown) at the right side of the cavity 16, goes through the passageway formed by the end of the wall 20 and a projection 63 on the inside of the wall 26, turns the corner at roller 54, twists 180 degrees, as shown at 66, between the roller 54 and the roller 58, and then exits from cavity 52 through opening or outlet port 44 and moves toward the front edge 42 of the cassette 10. The ribbon 30 moves along the front edge 42 in the direction of the arrow 34 and then goes through the entrance or inlet port at 46 and toward the drive means (not shown) which is normally positioned at the leftward side of the cavity 16 adjacent the wall 24. The front of the cassette 10 includes guide means 62 and 64, along with a ribbon guard or shield 65 which is preferably a thin plastic strip secured to the front edge 42 of the cassette 10. The guide means 62 and 64 are formed to both support and guide the ribbon 30 as it turns the corners at the front of the cassette 10. The ribbon 30, at least in part, is directed along a path behind the guard 65 and may be in contact therewith as it travels at an angle past the printing station. The ribbon guard or shield 65 permits the feeding of the ribbon 30 past the printing station without staining the paper.

Figure 2A:
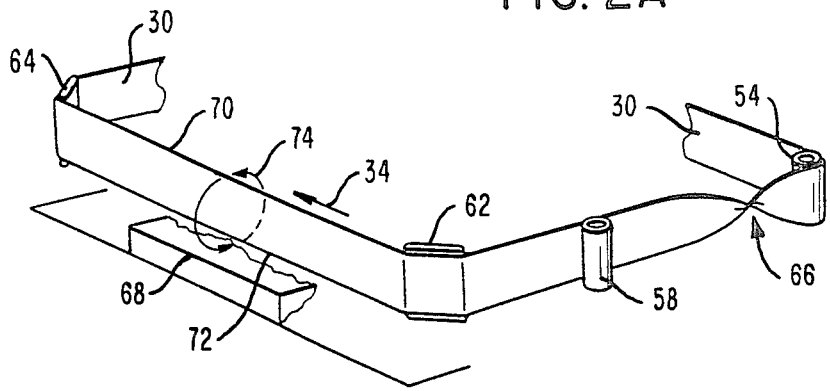
FIGS. 2A–2D illustrate an arrangement of a ribbon with an irregular fold or twist therein in successive stages of travel and also with ribbon frayed portions.

FIGS. 2A–2D illustrate an example of a relatively wide form of the ribbon 30 which is advanced from the cavity 16 of the cassette 10 through a ribbon twisting or reversing section 66 in the cavity 52, past the printing station, and back past the drive means (not shown) adjacent the cavity 36 and into the cavity 16 (FIG 1). FIG. 2A shows the ribbon 30 rounding the roller 54, going through the ribbon reversing section 66, past the roller 58 and around the supporting guide 62. The ribbon 30 is then advanced past the printing station wherein a print head carriage 68, which may also include a ribbon guide (not shown) on the printer which is positioned to direct the ribbon 30 in a precise path for printing operation, is caused to travel in reciprocating motion. The ribbon 30 then goes around the supporting guide 64 and back into the cavity 16.

FIG. 2A shows the ribbon 30 moving in the direction of the arrow 34, and exhibiting a straight length of the ribbon 30 with a top edge 70 and a bottom edge 72 with an encircling arrow 74 indicating turning or twisting of the ribbon 30 in the counterclockwise direction as viewed in the direction of travel of the ribbon past the print head carriage 68.

Figure 2B:
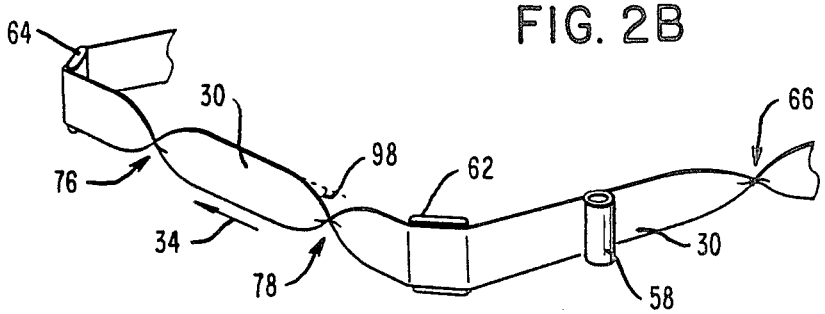

FIG. 2B shows a ribbon condition with irregular as unintended twisting of the ribbon 30 which may be caused when the ribbon cassette 10 is placed on the printer. The ribbon 30, between the guides 62 and 64 is subject to being caught on the print head carriage 68, or the printer ribbon guide (not shown), when being installed on the printer. If the installation is not properly done, the ribbon 30 can assume an irregular twisted condition, or having a portion or section of the ribbon unintentionally twisted 180 degrees, as at 76 when so caught on a printer part. The ribbon 30 is typically caused to be twisted in a direction wherein the lower edge 72 is turned upwardly toward the cassette 10, or in the counterclockwise direction, as indicated by the arrow 74 (FIG. 2A), and the ribbon 30 then has first and second folded or twisted portions, as at 76 and 78.

Figure 2C:
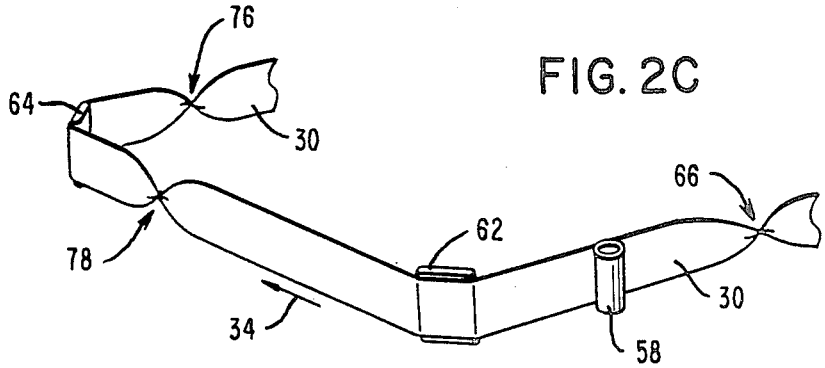

FIG. 2C shows the advancement of the ribbon 30 in the direction of the arrow 34 wherein the folded or twisted portion 76 has turned the corner around guide 64 and portion 78 is moving past the printing station.

Figure 2D:
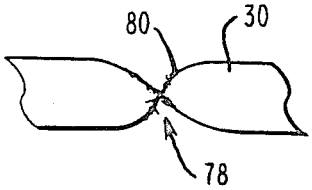

FIG. 2D shows a condition of the ribbon 30 which has the twisted portion 78 and which portion has been subjected to repeated impacts by the printing mechanism, which has caused or resulted in fraying, as at 80, of the ribbon 30 at the twisted portion.

Figure 3A:
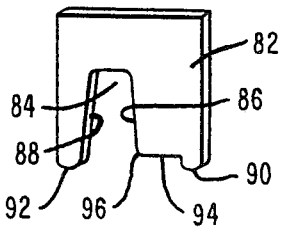
FIGS. 3A and 3B, respectively, show a perspective view and a right side view of a guide member for correcting a ribbon fold.
Figure 3B:
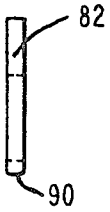

Referring back to FIG. 1, there is illustrated an irregular-shaped member 82 at the upper right portion thereof and which is shown to be positioned between rollers 54 and 58 of the ribbon reversing section 66. Although shown as a separate part, the member 82 is customarily attached to or fixed as an integral part of the cover 12. As better illustrated in FIGS. 3A and 3B, the member 82 is a thin plate member of generally square form except for defining a cutout or recess 84 having inclined sides 86 and 88. The recess 84 leaves rounded end portions 90 and 92, and a small cutout or recess at 94 defines an end portion or rounded corner 96.

FIGS. 4A–4E illustrate the folded or twisted ribbon 30 correcting operation and are described in sequential manner. While FIG. 1 shows the ribbon 30 in a stuffing condition as emerging from the chamber or cavity 16, the ribbon 30 is shown in a stretched configuration in FIG. 4A for convenience of illustration of the folded or twisted portions 76 and 78. The folded or twisted portions 76 and 78 may be the result of inadvertently or unintendedly catching the ribbon 30 on a part or portion of the printer when installing the ribbon cassette 10, as mentioned above, and such portions 76 and 78 are carried through the entire path of the ribbon 30 in the stuffed condition while traveling or advancing through the cavity 16.

The ribbon 30 approaches the twisting or reversing section 66 in cavity 52 after turning the corner around roller 54 in preparation for turning the ribbon 180 degrees in normal twisting operation. When the first folded or twisted portion 76 enters the ribbon reversing section 66, the normal twisting operation (ccw direction) provides for twisting the ribbon 30 in a direction opposite the twist direction (cw) of the first portion 76 and cancels out the twist in such portion, as shown being accomplished in FIG. 4B.

Figure 4A:
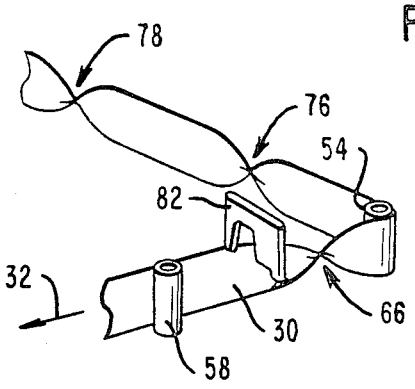
FIGS. 4A–4E show perspective views in successive or sequential travel of the ribbon and the operation of correcting the folded portion.
Figure 4B:
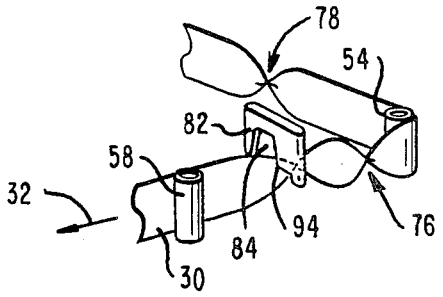
Figure 4C:
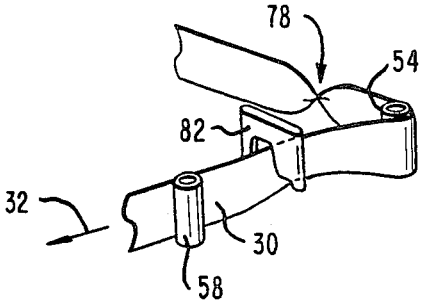

Since the ribbon 30 is drawn in the direction of the roller 58, the upper edge of the ribbon 30 enters in and is guided by the recess 84 of the guide member 82 for correcting the folded or twisted portion 76 and the ribbon 30 assumes an almost vertical position, as shown in FIG. 4C.

Figure 4D:
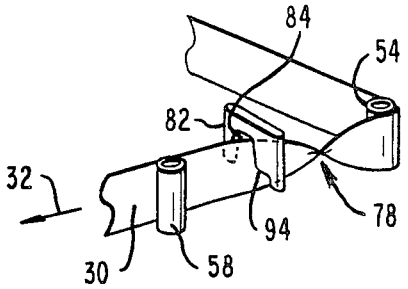
Figure 4E:
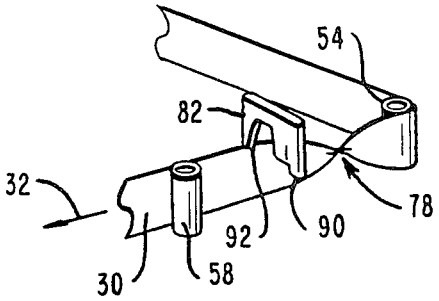

As the ribbon 30 is further advanced in the direction of the arrow 32 and enters the section 66 of cavity 52, the second folded or twisted portion 78, being folded in a condition or state wherein the right side thereof turns up, is made to contact the small recess or cutout 94 (see also FIG. 3A) of the guide member 82 for correcting the fold in the ribbon 30, as shown in FIG. 4D. The ribbon surface of the second folded portion 78 which is unfolded by the recess portion 94 is positioned to assume an almost horizontal position about midway between the rollers 54 and 58 due in part to the leftward tension of the ribbon 30 and dependent upon the driving force applied and acting on the ribbon 30. Both end portions 90 and 92 of the guide member 82 are brought into contact with the upper surface of the ribbon 30, as seen in FIG. 4E. The second folded or twisted portion 78 is used as the normal twist in the ribbon 30 as it passes through the ribbon reversing section 66 of cavity 52.

In the case wherein the ribbon 30 is folded or twisted irregularly in a direction (cw) opposite the direction (ccw) as just described, or wherein the ribbon 30 has been previously twisted in a direction opposite the direction of twisting as occurring in normal condition in the section 66, the guide member 82 is also effective for correcting such irregular folding or twisting. When the first folded portion 76 and the second folded portion 78 of the ribbon 30 advance through the section 66 for the first time after becoming irregularly folded or twisted, the twist in the ribbon 30 at the folded portion 76 and the twist of the ribbon normally occurring in the section 66 are not cancelled out since the ribbon 30 at the first folded portion 76 and the twist normally occurring in such loop section 66 are twisted in the same direction.

As a result of such action, the first folded portion 76 and the second folded portion 78 continue on in such condition unless these portions are unfolded to their original state in the section 66 only by reason of tension on the ribbon 30 for driving thereof. However, since the first and second folded portions 76 and 78 are inverted or twisted upon their first passage through the section 66, the direction of the twist of the ribbon 30 at the first folded portion 76 is converted to and assumes a direction (cw) opposite the normal ribbon twisting direction (ccw) in the section 66 when the first folded portion 76 enters the section 66 for the second time after traveling past the printing station and through the stuffing chamber 16 of the ribbon cassette 10, and the irregular folding of the ribbon 30 then is corrected in the manner as described above.

It should be noted that the section 66 provides a passageway for the ribbon 30 which is wider than the ribbon width at a predetermined position in the ribbon path of the ribbon cassette 10 to permit an irregular folded portion, as 76, of the ribbon 30 to be returned to its normal state or condition by the driving tension on the ribbon 30. However, if it is not possible to return the irregular folded portion 76 to the normal state or condition by the driving tension only on the ribbon 30, the small recess 94 of guide member 82 is utilized to aid or help the folded portion to be returned to the normal state under driving tension. Accordingly, if the folded ribbon 30 cannot be turned back to its normal state or condition by only the force of the driving tension or because of any other tension in the ribbon 30, the folded ribbon can be turned only by providing a passageway having enough length and width to turn the folded ribbon back without providing either a ribbon reversing section, as at 66, or a guide member, as 82.

The position and angle of the recess 84 in the guide member 82 for correcting an irregularly folded or twisted ribbon 30 and the position and angle of the small recess 94 in the member 82 are selected in accordance with the ribbon folding angle, illustrated at 98 in FIG. 2B, which angle depends on the length of the front portion 42 of the ribbon cassette 10, the width of the ribbon 30, and the length of the print head carriage 68.

Although in this embodiment of the invention, the guide member 82 for correcting an irregularly folded or twisted ribbon 30 is provided in a manner wherein both end portions 90 and 92 (FIG. 3A) of such member are brought into contact with the upper surface of the ribbon 30, the same effect can be attained by providing such guide member 82 under the ribbon 30 so that both end portions 90 and 92 can be brought into contact with the lower surface of the ribbon 30.

Figure 5A:
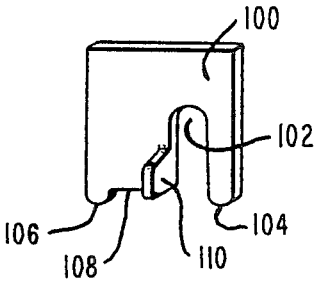
FIGS. 5A and 5B, respectively, show a perspective view and a right side view of another embodiment of the guide member.
Figure 5B:
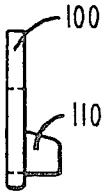

FIGS. 5A and 5B show a modification of the ribbon guide member which comprises a thin plate member 100 of generally square form except for defining a cutout or recess 102. The recess 102 leaves rounded end portions 104 and 106 and a small recess or cutout 108 between the recess 102 and the end portion 106. The guide member 100 has a separation end or projection 110 extending backwardly toward roller 54 (FIG. 1) which projection is provided and used for unfolding the second folded or twisted portion 78 more effectively. The projection 110 may be rod-shaped or any other configuration for guiding the ribbon 30 to correct an irregular fold or twist therein.

The irregularly folded or twisted ribbon 30 can be corrected by the guide apparatus wherein the member 82 is provided and positioned approximately at the center of the ribbon reversing section 66 of the cavity 52 (FIG. 1). When the ribbon folded or twisted portions 76 and 78 are advanced into the ribbon reversing section 66, the twisting of the ribbon 30 at such section cancels out the twist in the ribbon 30 at the first ribbon folded portion 76, and the twist in the ribbon 30 at the second ribbon folded portion 78 is utilized as the twist for reversing the ribbon 30 at the ribbon reversing section 66 by unfolding the second folded portion 78 with the aid of the separation end portion 96 of the guide member 82.

It is thus seen that herein shown and described is a guide mechanism in a ribbon cassette which utilizes a guide plate or like member that has a recess therein and rounded end portions engageable by the ribbon for accommodating the ribbon to correct any irregular twisting thereof. The mechanism of the present invention enables the accomplishment of the objects and advantages mentioned above, and while a preferred embodiment and a modification have been disclosed herein, other variations thereof may occur to those skilled in the art. It is contemplated that all such variations not departing from the spirit and scope of the invention hereof are to be construed in accordance with the following claims.

We claim:

1. A ribbon guide for use in a ribbon cassette having a storage chamber and means for directing the ribbon from the storage chamber along a line of printing and back to the storage chamber, and a ribbon reversing chamber for accommodating normal twisting of the ribbon in a Mobius twisting direction, said ribbon guide comprising a plate member positioned within the ribbon reversing chamber and oriented in a direction normal to the direction of travel of the ribbon, said plate member defining a recess through which the ribbon passes and having end surface portions engageable by the ribbon in normal travel thereof through said ribbon reversing chamber, said plate member including a projection thereon adjacent the recess and extending in the direction of ribbon travel, said projection engaging said ribbon for correcting unintended twisting thereof in a direction opposite the normal twisting direction as the ribbon is advanced through the ribbon reversing chamber.

2. A ribbon cassette comprising means within said cassette for storing said ribbon in stuffing manner, means for guiding said ribbon along a printing station and back into the storing means, means within said cassette for accommodating and twisting of said ribbon in one direction in normal operation, and plate means defining a plate-like member adjacent said storing means and oriented in a direction normal to the path of the ribbon, said plate means having a cutout therein and forming end portions engaging the surface of said ribbon, said plate member including a projection thereon adjacent the cutout and extending in the direction of ribbon travel, said projection engaging said ribbon for correcting unintended twisting thereof in a direction opposite said one direction of twisting said ribbon in normal operation as the ribbon is advanced through the ribbon accommodating and twisting means.

3. In a ribbon cassette containing a ribbon, means for storing the ribbon and means for guiding the ribbon into and out of the cassette and along a printing station for use in printing operations, the improvement comprising a ribbon reversing chamber for turning the ribbon in one direction in normal operation, and plate means comprising a plate member positioned within the ribbon reversing chamber and oriented in a direction normal to the path of the ribbon for engaging the edges of the ribbon, said plate member defining a recess therein and including a projection adjacent the recess and extending in the direction of ribbon travel for correcting unintended turning thereof in a direction opposite the direction of turning the ribbon in normal operation as the ribbon is advanced through the ribbon reversing chamber.

* * * * *